US010286409B2

(12) United States Patent
Holmes

(10) Patent No.: US 10,286,409 B2
(45) Date of Patent: May 14, 2019

(54) SPRINKLER HEAD

(71) Applicant: Katco Holdings Pty Ltd, Wangi Wangi (AU)

(72) Inventor: Tony Holmes, Wangi Wangi (AU)

(73) Assignee: Katco Holdings Pty Ltd, Valentine, New South Wales (AU)

( * ) Notice: Subject to any disclaimer, the term of this patent is extended or adjusted under 35 U.S.C. 154(b) by 0 days.

(21) Appl. No.: 15/031,469

(22) PCT Filed: Oct. 28, 2014

(86) PCT No.: PCT/AU2014/050316
§ 371 (c)(1),
(2) Date: Apr. 22, 2016

(87) PCT Pub. No.: WO2015/061849
PCT Pub. Date: May 7, 2015

(65) Prior Publication Data

US 2016/0256877 A1 Sep. 8, 2016

(30) Foreign Application Priority Data

Oct. 29, 2013 (AU) ..... 2013904168

(51) Int. Cl.
*B05B 3/00* (2006.01)
*B05B 3/04* (2006.01)

(52) U.S. Cl.
CPC ..... *B05B 3/0486* (2013.01); *B05B 3/008* (2013.01); *B05B 3/0427* (2013.01)

(58) Field of Classification Search
CPC ..... B05B 3/008; B05B 3/0486; B05B 3/0427; B05B 3/0445; B05B 3/005
USPC ..... 239/222.17, 222.21, 222.11, 231, 239/380–383, 214, 237, 229
See application file for complete search history.

(56) References Cited

U.S. PATENT DOCUMENTS

| | | | | |
|---|---|---|---|---|
| 2,848,276 A | | 8/1958 | Clearman | |
| 3,312,400 A | * | 4/1967 | Clearman | B05B 3/00 239/206 |
| 3,532,273 A | * | 10/1970 | Buckingham | A01J 7/025 239/222.17 |
| D253,364 S | | 11/1979 | McFadden | |
| 4,398,666 A | | 8/1983 | Hunter | |
| 5,381,960 A | * | 1/1995 | Sullivan | B05B 3/008 239/222.17 |
| 5,439,174 A | * | 8/1995 | Sweet | B05B 3/008 239/222.17 |
| 5,669,449 A | | 9/1997 | Polan et al. | |
| 5,950,927 A | | 9/1999 | Elliott et al. | |

(Continued)

OTHER PUBLICATIONS

International Preliminary Report on Patentability, dated Oct. 8, 2015, PCT International App. No. PCT/AU2014/050316, Katco Holdings Pty Ltd, 9 pgs.

*Primary Examiner* — Viet Le
*Assistant Examiner* — Steven M Cernoch
(74) *Attorney, Agent, or Firm* — Chernoff, Vilhauer, McClung & Stenzel, LLP

(57) ABSTRACT

A sprinkler fitting comprises a spout and a deflector moveably connected to one another, the deflector being formed from a resilient material in a single piece. The sprinkler fitting may be manufactured by; forming a spout; molding a deflector in a resilient plastics material; and pressing the deflector onto the spout.

13 Claims, 2 Drawing Sheets

(56) References Cited

U.S. PATENT DOCUMENTS

| | | | | |
|---|---|---|---|---|
| 6,176,440 | B1 | 1/2001 | Elliott | |
| D438,933 | S | 3/2001 | Sundholm | |
| 6,199,771 | B1 * | 3/2001 | Clearman | B05B 3/008 239/222.11 |
| 6,267,299 | B1 * | 7/2001 | Meyer | B05B 3/008 239/222.11 |
| 6,276,460 | B1 | 8/2001 | Pahila | |
| 6,341,733 | B1 * | 1/2002 | Sweet | B05B 3/0486 239/222.17 |
| 6,976,543 | B1 | 12/2005 | Fischer | |
| 7,240,860 | B2 * | 7/2007 | Griend | B05B 3/0486 239/381 |
| D550,808 | S | 9/2007 | Franson et al. | |
| D552,712 | S | 10/2007 | Franson et al. | |
| 7,287,710 | B1 | 10/2007 | Nelson et al. | |
| 7,540,330 | B2 | 6/2009 | Orr et al. | |
| 7,854,269 | B2 | 10/2010 | Franson et al. | |
| 7,942,345 | B2 * | 5/2011 | Sesser | B05B 3/008 239/222.11 |
| 8,028,932 | B2 * | 10/2011 | Sesser | B05B 3/008 239/222.11 |
| 8,403,186 | B2 * | 3/2013 | Kurosawa | B29C 45/14598 138/148 |
| 8,662,190 | B2 | 3/2014 | Watson | |
| 8,991,724 | B2 * | 3/2015 | Sesser | B05B 7/12 239/222.11 |
| D748,224 | S | 1/2016 | Holmes | |
| 2005/0029364 | A1 | 2/2005 | Burcham et al. | |
| 2005/0087622 | A1 | 4/2005 | Burcham | |
| 2006/0108445 | A1 | 5/2006 | Pinch et al. | |
| 2006/0249594 | A1 | 11/2006 | Pinch | |
| 2008/0017732 | A1 | 1/2008 | Perkins et al. | |
| 2009/0078788 | A1 | 3/2009 | Holmes | |

* cited by examiner

SPRINKLER HEAD

CROSS-REFERENCE TO RELATED APPLICATIONS

This is a national stage application filed under 35 USC 371 based on International Application No. PCT/AU2014050316, filed Oct. 28, 2014, and claims priority under 35 USC 119 to Australian Patent Application No. 2013904168, filed Oct. 29, 2013.

INTRODUCTION

Described herein is a sprinkler fitting for irrigation of plants, and in particular an offset rotary action sprinkler and a method of manufacturing and assembling an offset rotary action sprinkler.

BACKGROUND OF THE INVENTION

Offset rotary action sprinklers are generally used as agricultural irrigation sprinklers but because of their desirable performance at low to medium pressures they are becoming more commonly seen in domestic applications for watering smaller areas such as lawns, gardens and plant nurseries etc.

A feature of the operation of an offset rotary action sprinkler is that it has only one moving part, which is a gyrating deflector. The deflector has an annular member or 'rolling ring' held in place between two opposed surfaces provided around a threaded spout to which it is movably connected. The deflector also includes a set of offset radial deflector surfaces or 'spray grooves' connected to the rolling ring. The deflector is caused to roll, tilt and rotate, by the action of a water jet directed onto an apex of the spray grooves from a nozzle in the threaded spout. The spray grooves redirect the water jet from an axial trajectory to a radial (outwardly directed) trajectory. The grooves are typically located in or on a surface of a 'spray cone' which is connected directly to the rolling ring by posts which are located between the offset radial spray grooves, allowing the deflected water jet to exit the sprinkler fitting unimpeded. As the spray cone rotates, the water jet is deflected by different spray grooves, which break the water jet into 'slugs' and distribute the slugs of water radially. Offset rotary action sprinklers operate at varying pressures and flow rates to achieve different water distribution diameters and application rates appropriate to the application to which they are particularly targeted (e.g. agricultural or domestic applications). However, common to the design of all prior offset rotary action sprinklers is the manner of assembly, in which the threaded spout and deflector are each in turn made of at least two components assembled in a sequence that permits connection of the deflector to the threaded spout.

The threaded spout comprises the nozzle and an interconnecting thread provided to screw the threaded spout to a sprinkler base or pipeline water source. This threaded spout also includes a pair of opposed surfaces which are normal to the axis of the threaded spout and which retain the rolling ring of the deflector connected to the threaded spout and restrain the motion of the deflector. The two components of the threaded spout each provide one of the pair of opposed surfaces such that the two parts may be assembled to place the two opposed surfaces on opposite sides of the rolling ring, to thereby loosely hold the rolling ring located about the nozzle. The spray cone is then mounted on the rolling ring.

Thus to make a prior art offset rotary action sprinkler, requires the assembly of the two parts, each of which comprises multiple components, to enable the retention of the deflector of the sprinkler fitting within the confinement of the opposed faces of the threaded spout and to permit the rolling, tilting, rotating, or 'gyrating' action of its operation.

Two methods are commonly used to retain the deflector in position. One method involves having a removable nozzle component or nozzle retention component screwed to the top section of the threaded spout of the sprinkler fitting. The removable nozzle or nozzle retention component has a collar having an outer diameter larger than an opening in the annular rolling ring of the deflector. With the nozzle component or nozzle retention component removed, the annular rolling ring easily fits over the shank of the threaded spout. The nozzle component or nozzle retention component is then screwed down into position in the threaded spout to retain the deflector.

The other prior art method of assembling the deflector to the threaded spout involves placing the annular rolling ring over the shank of the threaded spout and pressing a flexible collar over the nozzle to retain the deflector.

In each case assembly of these prior art sprinklers requires the threaded spout to be made from two or more components whereby a rolling ring component is fitted over the spout and a retention component is then attached. Similarly the deflector comprises a rolling ring and a spray cone, which must be assembled together after the rolling ring is retained on the threaded spout.

BRIEF SUMMARY OF THE INVENTION

According to a first aspect, as sprinkler fitting comprises a spout and a deflector connected to one another, the deflector being formed from a resilient material in a single piece. The spout may have a threaded proximal end with a water inlet for connection to water supply. The spout may have a nozzle at a distal end in fluid communication with a water inlet at the proximal end. The spout may have a circumferential groove between the proximal and distal ends of the spout. The deflector may have an annular member retained in the groove of the spout. The deflector may have a generally cone shaped spray deflector connected to the annular member. The deflector may have an apex directed generally towards the nozzle and spray grooves extending from the apex towards an outer extremity of the deflector. An opening in the annular member may be smaller than an outer edge of the groove. The spout may be a unitary part. The spout may be moulded, cast or machined. The spout may be made of plastic or metal.

According to a second aspect a sprinkler fitting is manufactured by forming a spout and a movable part and pressing the movable part onto the spout. The annular member of the deflector may be pressed over the distal end of the spout to be engaged in the groove.

The deflector may be moulded in a first resilient mouldable material in a single resilient plastic moulding. The spout may be moulded from a mouldable material in a single moulding. The spout may be moulded in a second mouldable material different from the first mouldable material. The first mouldable material may be a resiliently deformable material with sufficient resilience to allow the opening in the annular member to stretch over the widest point between the circumferential groove and the nozzle of the spout and relax to be retained in the groove.

The deflector may be formed with any number of spray grooves and could, for example have 2, 3, 4, 5, 6 or more spray grooves.

BRIEF DESCRIPTION OF THE SEVERAL VIEWS OF THE DRAWINGS

Embodiments of the invention will now be described by way of example with reference to the accompanying drawings in which.

DETAILED DESCRIPTION OF THE INVENTION

Disclosed herein is an offset rotary action sprinkler fitting, which has a resilient deflector. A method for the manufacture of such a sprinkler fitting is also described. By using a resilient deflector, the complete sprinkler fitting may be produced by making and assembling only two moulded parts. These two parts comprise of the threaded spout and the resilient deflector, each of which are separately moulded as single parts.

Figure 1:
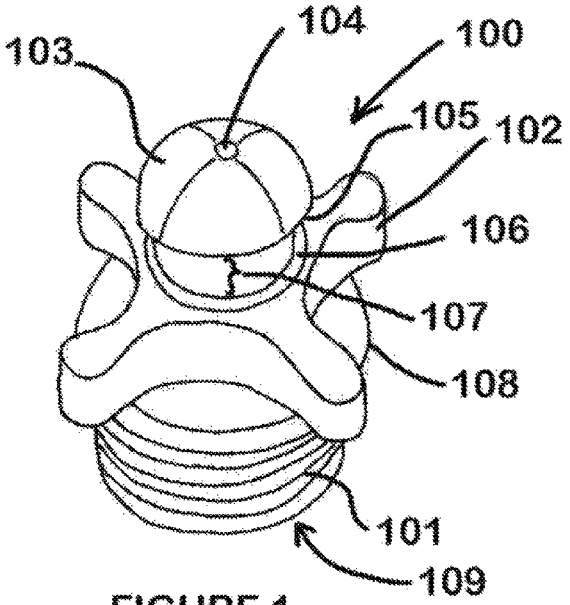
FIG. 1 is a perspective view of a spout of an offset rotary action sprinkler fitting.
Figure 2:
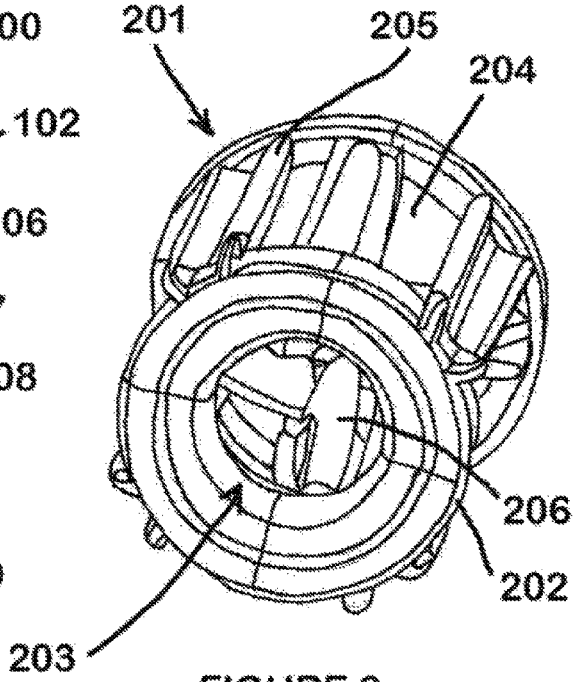
FIG. 2 is a perspective view from the bottom (rolling ring end) of a deflector of the an offset rotary action sprinkler fitting, suitable for assembly with the spout of FIG. 1.
Figure 3:
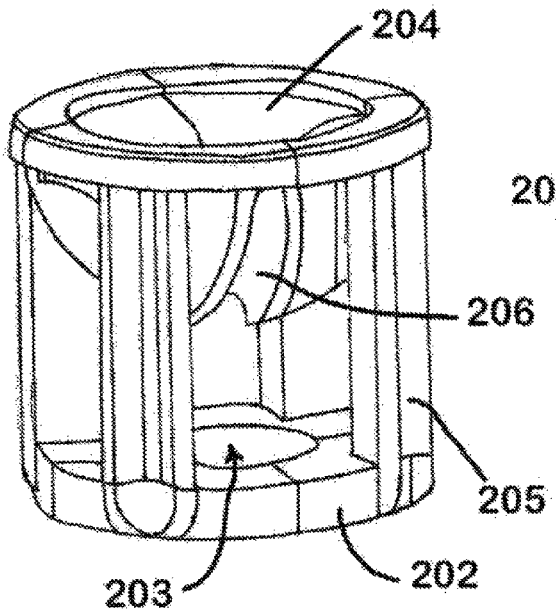
FIG. 3 is a perspective view from the front of the deflector of FIG. 2.

Referring to FIG. 1, a threaded spout 100 is provided to attach the sprinkler fitting to a fixed water supply pipe work, or a sprinkler base connected to a water supply via a hose.

The threaded spout 100 is moulded in one piece and comprises a hollow body 108 having a tubular threaded inlet section 101 at one end which provides an inlet opening 109 and a mushroom shaped outlet section 103 at the other end which provides a nozzle outlet 104. The nozzle outlet 104, functions to produce a jet of water, which is directed at the deflector 201 (see FIGS. 2 to 5). The threaded inlet section 101 allows connection of the sprinkler fitting to a water supply. A shoulder area 105 of the mushroom shaped outlet section 103 provides a retaining surface for the deflector 201 to prevent the deflector from separating from the spout 100 after assembly. Below the shoulder 105 is a hollow shank 107, having an internal passage which provides fluid communication between the inlet opening 109 and the outlet nozzle 104. The outer surface of the hollow shank 107 provides the contact surfaces for the rolling, tilting, rotating action of the resilient deflector 201.

Figure 5:
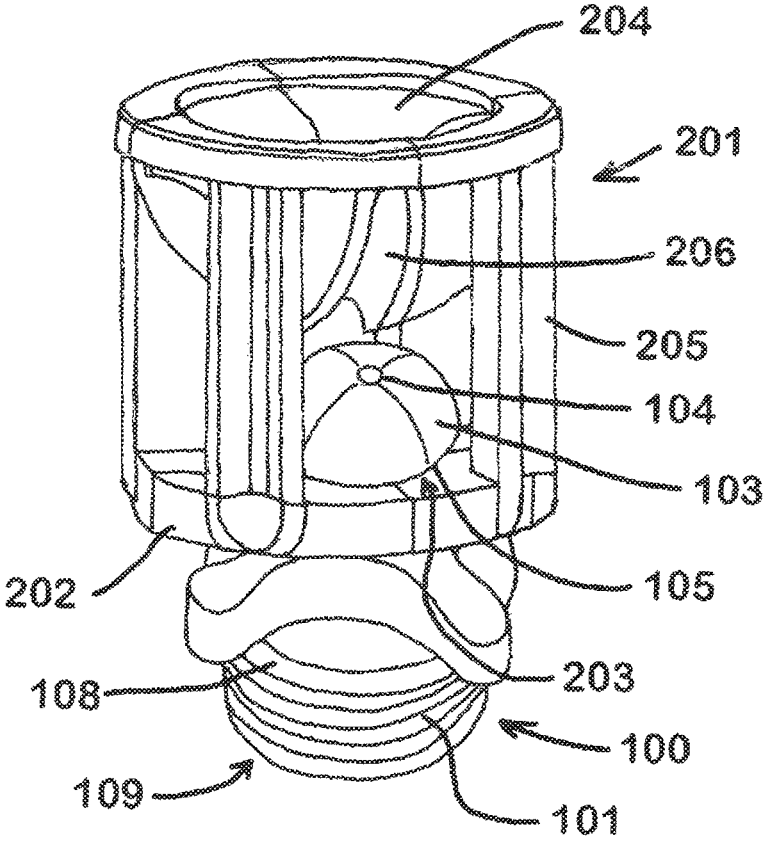
FIG. 5 is a perspective view of an offset rotary action sprinkler fitting comprising the deflector of FIGS. 2, 3 & 4 fitted to the spout of FIG. 1.

The threaded spout 100 is also provided with a grip 102 that assists with the tightening of the spout when screwed into a mating threaded outlet of the water supply or sprinkler base. The upper surface of the grip 102 provides a second restraining surface 106 of the spout such that the shank 107 is bounded at its ends by the lower restraining surface 106 and the surface under shoulder 105. In the example as illustrated in FIGS. 1 & 5, the spout is shown having (optionally) four radial projections 102 for easy installation without the use of tools but other non-exhaustive examples include hexagonal or square sections for use with a spanner, or a knurled round section.

The threaded spout can also be manufactured using many different types of material, including but not limited to metals such as copper, brass, bronze or aluminium and alloys of these metals, and various plastics materials such as nylon, polypropylene, polyethylene and PVC.

Referring to FIGS. 2, 3, 4 & 5, the resilient deflector 201 is the moving part of the sprinkler. The resilient deflector is moulded in a single part incorporating the spray cone 204, annular rolling ring 202 and interconnecting posts 205.

The annular rolling ring 202 includes a central opening 203, which sits around the shank 107 of the spout 100 when the sprinkler fitting is assembled. The diameter of the shank 107 is smaller than the opening 203 by an amount that provides the correct clearances to allow the resilient deflector 201 to roll, tilt, rotate or 'gyrate'.

The resilient deflector illustrated in FIGS. 2 to 5 is shown as having four support posts 205 connecting the rolling ring 202 to the spray cone 204. Correspondingly there are four spray grooves 206, 401 formed on the spray cone 204. However the deflector can be formed with any number of spray grooves and could, for example have 2, 3, 4, 5, 6 or more spray grooves. The spray grooves 206, 401 are offset from the centre of the deflector such that water deflected by the spray grooves 206, 401 creates a tilting force and a rotational force on the deflector 201 causing it tilt to one side and to roll around the shank 207 of the spout 100. As the deflector rolls around the shank, different spray grooves 206, 401 move into the path of the water jet emerging from the nozzle outlet 104 causing the water jet to be broken into slugs of water which are deflected in different directions and to the required diameters for desired water coverage.

Figure 4:
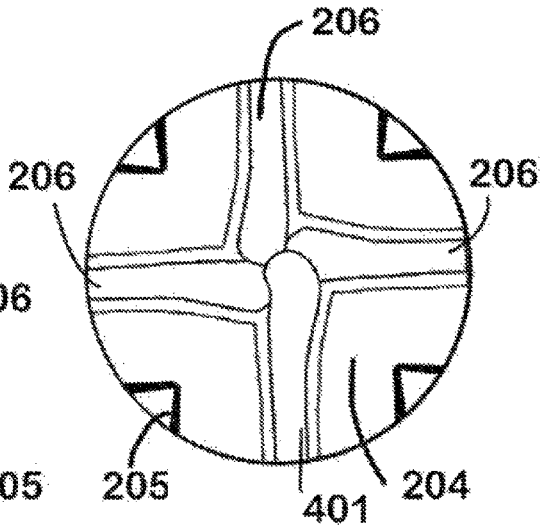
FIG. 4 is a sectional view of the deflector of FIGS. 2 & 3, showing the spray cone and spray grooves viewed from the bottom (rolling ring end)
Figure 6:
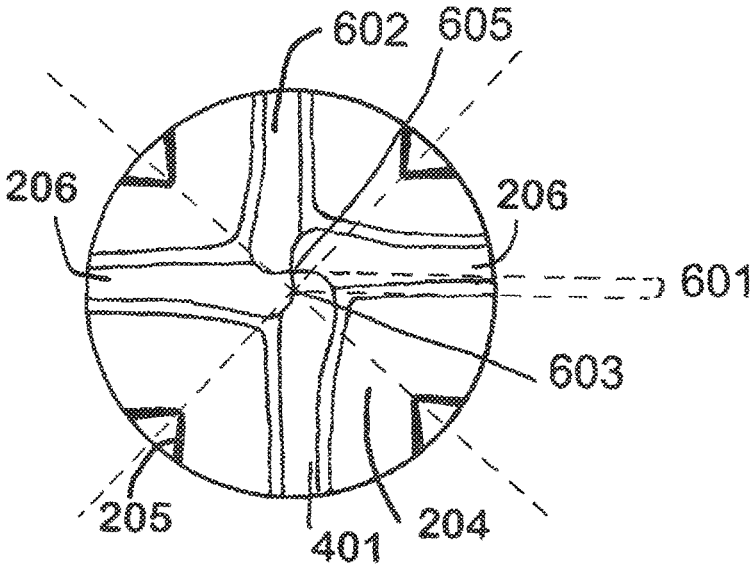
FIG. 6 is a sectional view of the deflector of FIGS. 2 & 3, showing the spray cone and spray grooves viewed from the bottom (rolling ring end), in an alternative embodiment in which the whole spray groove structure is offset slightly from the centre of the resilient deflector.

When the resilient deflector 201 is stationary with the water supply shut off to the nozzle outlet 104, the resilient deflector will tend to fall into a position with the centre of the spray cone 204 located directly over the nozzle outlet 104. If the spray grooves 206 and 401 comprise a plurality of symmetrical grooves (e.g. 4 in the described embodiment), the sprinkler can stall when water is turned on creating jets of water emerging from each of the spray grooves 206 & 401. By making one spray grove 401 longer than the others, it impinges on the inner ends of spray grooves 206 and encompasses the apex of the spray cone 204, causing a slight bias which helps the sprinkler to start in such circumstances. The spray groove 401 may be made longer by extending it past the centre of the resilient deflector 201 such that it encroaches on the space that would otherwise be occupied by the other spray grooves 206, as seen in FIG. 4. Alternatively, as seen in FIG. 6, the whole spray groove structure may be offset slightly from the centre of the resilient deflector 603 where the centre of intersection 605 of the spray grooves 206, 401 is displaced from the centre of the resilient deflector 603 by an offset 601, whereby the spray groove 401 is longer than spray grooves 206, and the spray groove 602 is shorter than spray grooves 206.

The four posts 205 are shaped to improve rigidity and provide adequate support and strength such that the spay cone 204 does not vibrate excessively.

The material from which the deflector 201 may be moulded is selected from materials that, when moulded, have a shore D hardness of in the range of 35-40 and typically 37-38, or a shore A hardness of in the range of 87-92 and typically 89-90. The selected material may have a Vicat Softening Temperature in the range of 60-70° C., and may have a tensile strain at break of >100%. One example of a class of material that may be used is an Ethylene Vinyl Acetate Copolymer Resin.

Manufacturing the resilient deflector in a single moulded part simplifies manufacture by reducing the number of assembly steps for the sprinkler fitting. The deflector 201 and the spout 100 are designed to be assembled by pressing the rolling ring 202 of the deflector over the nozzle 103 of the spout 100 whereby the rounded shape of the outlet section 103 assists the rolling ring 202 to expand to pass over the nozzle. Once the rolling ring 202 has passed over the outlet section 103, it snaps back to its original shape and size due to the resilient nature of the material from which it is manufactured and the rolling ring is then retained under the shoulder 105 of the nozzle and located around the shank 107 between the shoulder 105 and the lower retaining surface 106. It takes significant force to remove the deflector 201 from the spout 100 once they are assembled together due to the shape of the components.

When selecting plastic material for the manufacture of the resilient deflector 201 it should have adequate flexibility and memory such that when the opening 203 is pressed over the outlet section 103 it can return to substantially the original manufactured diameter and thus to provide the correct operating tolerances to roll, tilt, rotate or 'gyrate' around the shank 107 of the threaded spout 100.

The upper surface of the outlet section 103 is rounded to provide a cam surface, which assists with the stretching of the opening 203 in the rolling ring 202 when the deflector is being pressed onto the spout 100, however the under side of the shoulder 105 of the nozzle is squared off to reduce the ability of the opening 203 to stretch over the shoulder 105 when a force is applied to the deflector 201 in a direction to remove it from the spout 100.

The resilient deflector described in the example above has several desirable features that may be beneficial to the manufacture of embodiments of an offset rotary action type sprinkler. The resilient plastic may be selected to have extremely good wear characteristics, which are assisted by the direct continual contact with fluids such as water acting as a lubricant and coolant for the constantly rolling surface of the rolling ring 202. This may allow a longer working life of the product and may make it suitable for use in commercial applications where sprinklers are commonly be operated continuously.

The illustrated sprinkler fitting may be provided in a number of sizes and configurations depending on the intended application.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A sprinkler fitting comprising a spout and a deflector moveably connected to one another, (a) the spout having a threaded proximal end with a water inlet for connection to a water supply, a nozzle at a distal end in fluid communication with the water inlet at the proximal end and a circumferential groove between the proximal and distal ends of the spout, said spout defines a convex shaped outlet section proximate said nozzle defining an outlet section exterior periphery having a first diameter, said spout being formed in a single unitary piece;

(b) the deflector defining a ring defining a central opening there through at a lower portion of a spray cone, said central opening of said ring having an interior periphery having a second diameter, said first diameter is greater than said second diameter, said spray cone maintained in a fixed relationship with respect to said ring in such a manner that said spray cone is movable as one with said ring, said deflector attached to said spout with a pressing engagement where said ring of said deflector is expanded to form said pressing engagement by said ring expanding so that said second diameter of said interior periphery expands to an increased diameter greater than said first diameter to fit over said convex shaped outlet section and then contracts after passing over said convex shaped outlet section whereby said ring is retained in the circumferential groove of the spout; said spray cone connected to the ring, the spray cone being generally cone shaped and including a plurality of spray grooves; an apex of the spray cone directed generally towards the nozzle; and the spray grooves extending from the apex towards an outer extremity of the deflector, and (c) the deflector being moulded in a single unitary piece from a resilient material having a shore A hardness, when moulded, within the range of 87 to 92.

2. The sprinkler fitting as claimed in claim 1, wherein one of the spray grooves is longer than at least one of the remaining spray grooves.

3. The sprinkler fitting of claim 2 wherein the one of the spray grooves is longer than all of the remaining spray grooves.

4. The sprinkler fitting of claim 3 wherein the plurality of spray grooves is offset from the centre of the resilient deflector whereby the one of the spray grooves is made longer than all of the remaining spray grooves.

5. The sprinkler fitting of claim 1 wherein the central opening in the ring is smaller than an outer edge of a shoulder bounding the circumferential groove of the spout.

6. The sprinkler fitting as claimed in claim 1, wherein the spout is moulded in plastic material in a single unitary piece.

7. The sprinkler fitting as claimed in claim 1 wherein the spout is cast in metal.

8. The sprinkler fitting as claimed in claim 1 wherein the spout is machined from plastic or metal material in a single unitary piece.

9. The sprinkler fitting of claim 7 wherein the one of the spray grooves is longer than all of the remaining spray grooves.

10. The sprinkler fitting of claim 7 wherein the central opening in the ring is smaller than an outer edge of a shoulder bounding the circumferential groove of the spout.

11. The sprinkler fitting of claim 3 wherein the spout is moulded in plastic material in a single unitary piece.

12. The sprinkler fitting as claimed in claim 4 wherein the spout is cast in metal in a single unitary piece.

13. The sprinkler fitting as claimed in claim 3 wherein the spout is machined from plastic or metal material in a single unitary piece.

* * * * *